United States Patent [19]

Murphy et al.

[11] Patent Number: 4,704,827

[45] Date of Patent: Nov. 10, 1987

[54] MODULAR BOOTH STRUCTURE

[75] Inventors: Michael Murphy; Henry Belszek, both of Columbus, Ohio

[73] Assignee: National Icee Corporation, Philadelphia, Pa.

[21] Appl. No.: 858,344

[22] Filed: May 1, 1986

[51] Int. Cl.[4] ..... A47K 3/16

[52] U.S. Cl. ..... 52/34; 62/390

[58] Field of Search ..... 52/105, 34–36, 52/79.1, 79.5, 90, 93, 105, 473, 63, 66, 397; 296/22; 62/390; 49/388, 390

[56] References Cited

U.S. PATENT DOCUMENTS

| | | | |
|---|---|---|---|
| 651,251 | 6/1900 | Karr | 52/90 |
| 780,265 | 1/1905 | Closson | 296/22 |
| 971,613 | 10/1910 | Hollister | 135/101 |
| 2,001,215 | 5/1935 | Ruppel | 52/93 |
| 2,208,010 | 7/1940 | Whitmore | 52/90 |
| 2,480,562 | 8/1949 | Ewing | 52/473 |
| 2,528,211 | 10/1950 | Civkin et al. | 52/105 |
| 3,771,264 | 11/1973 | Sawie | 49/390 |
| 4,073,098 | 2/1978 | Baker | 52/66 |
| 4,075,814 | 2/1978 | Theurer et al. | 52/79.5 |
| 4,407,099 | 10/1983 | McLaughlin | 52/397 |
| 4,493,441 | 1/1985 | Sedam et al. | 62/390 |

FOREIGN PATENT DOCUMENTS

| | | | |
|---|---|---|---|
| 1255406 | 1/1961 | France | 52/79.1 |

*Primary Examiner*—James L. Ridgill, Jr.

*Attorney, Agent, or Firm*—Paul & Paul

[57] ABSTRACT

A modular booth structure is provided which is particularly useful in merchandising of food and drink items. The booth comprises a free-standing base portion comprising a plurality of vertical panels arranged to form a rectangular enclosure, a door in one of the panels, a plurality of cabinet units disposed within the enclosure and against the panels, with each of the cabinet units having a substantially planar top surface forming a countertop within the enclosure. The base includes a first plumbing system comprising a sink, a supply of water for the sink, a heater unit for heating water delivered to the sink, means for delivering water to the sink, and a holding tank for collecting water discharged from the sink. A second plumbing system is also provided which comprises a supply of water for a beverage dispenser, a supply of carbon dioxide for a beverage dispenser, and means for delivering water to the beverage dispenser. A cover portion is also provided comprising a plurality of pipes joined together by angled brackets to form a lattice structure. The cover portion has a vertical component which is attached to the panels of the base, a horizontal top, and an angled component joining the vertical component to the top. A plurality of transparent panels are disposed coplanar to the vertical component of the cover portion and a plurality of awnings cover the angled component, whereby a self-contained, decorative merchandising booth is obtained for the sale of food and drink items.

8 Claims, 6 Drawing Figures

MODULAR BOOTH STRUCTURE

CROSS-REFERENCE TO RELATED APPLICATION

The ornamental design of the present invention is the subject of our copending design patent application, Ser. No. 859,721, filed May 1, 1985, entitled MODULAR MERCHANDISING BOOTH.

BACKGROUND OF THE INVENTION

This invention relates generally to static building structures and more particularly to a modular, self-contained booth for use in merchandising food and drink items, and is particularly adapted for use as a snack bar inside existing buildings such as discount stores, supermarkets, etc.

Many types of booth structures are generally known in the art. These known booth structures range in style and utility from simple wooden structures used primarily at outdoor events such as carnivals, fairs and sporting events to complex, prefabricated structures used to sell merchandise in store parking lots and the like. Other types of booth structures are known for use inside of existing buildings, such as in airport terminals or the familiar customer service booth in supermarkets and discount stores.

A particular problem arises in connection with the merchandising of food and drink items, however, in that certain equipment is required, such as for example a sink and water supply. As such, snack areas in discount stores and the like often required an external plumbing system and a rather large area to accomodate the equipment. Furthermore, it was often difficult and expensive to retrofit an existing structure to accomodate a snack area, particularly where a plumbing system has to be provided.

We have invented a self-contained booth for use in merchandising of food and drink items inside of existing building structures which does not require a large amount of space, which does not require expensive retrofit application, which contains all of the necessary apparatus and equipment to render the need for a separate plumbing system unnecessary and which is aesthetically pleasing to the consumer.

The ornamental design of the modular booth structure in accordance with the invention is the subject of a copending design patent application, Ser. No. 859,721, filed May 1, 1985, entitled MODULAR MERCHANDISING BOOTH. This above-mentioned application constitutes the most relevant prior art known to us.

SUMMARY OF THE INVENTION

In accordance with the invention, a modular booth structure for use in merchandising of food and drink items comprises a free-standing base comprising a plurality of vertical panels arranged to form a rectangular enclosure, wherein one of the panels is hinged to an adjacent panel to form a door, a plurality of cabinet units disposed within the enclosure so as to abut the panels, each of said cabinets being provided with a planar top surface which forms a counter inside the enclosure. A sink is provided in one of the cabinet units and a holding tank is also provided to collect water discharged from the sink. The other cabinet units contain portable water tanks, carbon dioxide tanks, and a heater unit, which cooperate together to store and deliver hot and cold water to the sink and water and carbon dioxide to a beverage dispenser. A cover portion is attached to the base portion to complete the booth and comprises a plurality of pipes connected together to form a lattice structure having a vertical component disposed so as to form a substantially vertical extension of the panels of the base portion, a horizontal top component, and an angled component joining the top to the vertical component. A plurality of transparent panels are affixed to the vertical component of the cover portion and are connected to the pipes. A plurality of awnings are disposed to cover the angled component of the cover portion, whereby a self-contained merchandising both is obtained which is both efficient and aesthetically pleasing.

Accordingly, it is a primary object of the invention to provide a modular booth structure which is capable of extensive retrofit application.

It is another object of the invention to provide a modular booth structure for use in merchandising of food and drink items which does not require an external plumbing system.

It is another object of the invention to provide a self-contained modular booth structure which is inexpensive to manufacture and is easy to assembly and disassemble.

It is another object of the invention to provide a self-contained modular booth structure having a free-standing base comprising a plurality of vertical panels arranged to form a rectangular enclosure wherein one of the panels is hinged to an adjacent panel to form a door; a plurality of cabinet units disposed within the enclosure so as to abut the panels, each of which has a planar top surface to form a counter in the enclosure; a first plumbing system comprising sink means within one of the cabinet units; means for storing, delivering and heating water for the sink means; and means for collecting and holding water discharged from said sink means; and a second plumbing system comprising means for storing and delivering carbon dioxide to a beverage dispenser and means for storing and delivering a supply of water to a beverage dispenser; and a cover portion attached to said base portion comprising a plurality of pipes connected together to form a lattice structure having a vertical component, a horizontal top component, and an angled component connecting said vertical component and said top surface.

These and other objects of the invention will become apparent upon a reading of the following detailed description of the invention with reference to the drawings and the appended claims.

DETAILED DESCRIPTION OF THE INVENTION

Figure 1:
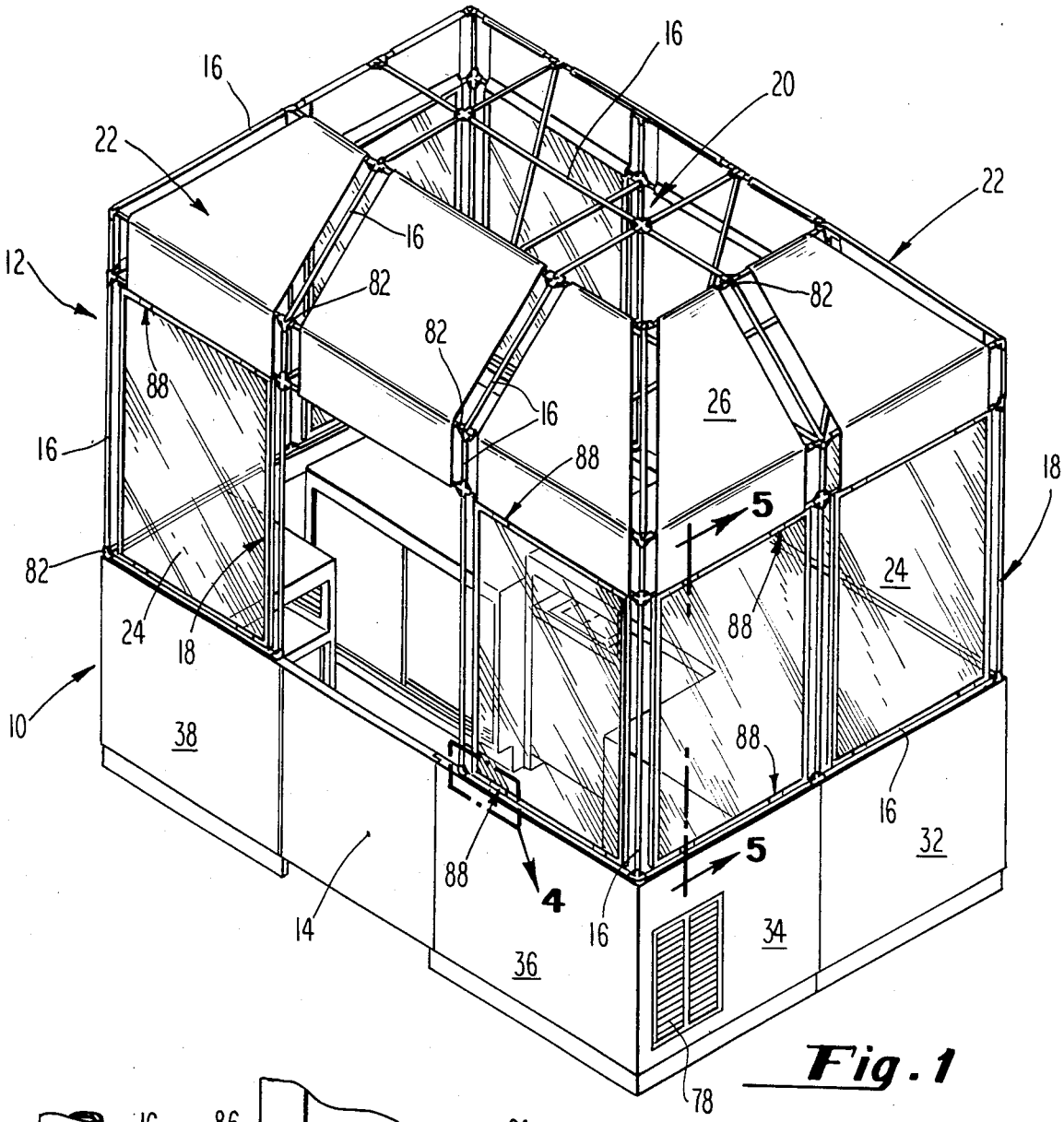
FIG. 1 is a perspective view of the modular booth structure in accordance with the invention.

With reference first being made to FIG. 1, the modular booth structure of the invention comprises a base portion 10 and a cover portion 12 connected thereto. The base portion 10 comprises a plurality of panels arranged to form a substantially rectangular enclosure. A door 14 is provided in the base portion to allow acess to the interior of the enclosure. Positioned within the enclosure are a plurality of cabinet units, the function and structure of which is more particularly described hereinbelow.

As also can be seen from FIG. 1, the cover portion 12 comprises a plurality of hollow tubes or pipes 16 joined together to form a lattice structure. The pipes 16 are preferrably made of plastic to facilitate in manufacture and assembly of the booth, and are so arranged to form a vertical component 18, a horizontal component 20 in the top of the cover portion 12, and an angled component 22 connecting the verticle component to the horizontal component. The vertical component 18 of cover portion 12 is disposed above and substantially parallel to the panels of base portion 10 so as to form a substantially vertical extension of the panels and is connected to the panels, as yet to be described with reference to FIG. 4. A plurality of transparent panels 24 are rigidly affixed to the pipes 16 which form the vertical component 18. Awnings 26 may also be provided to cover the angled component 22 of the cover portion 12. The transparent panels 24 and awnings 26 may carry suitable indicia advertising the products available for sale from the booth. It is most preferable for the transparent panels 24 to be made of a clear plastic material, such as PLEXIGLAS, to faciliatate ease of assembly and for safety considerations. The awnings 26 are preferably made of a fabric material, but may also be made of vinyl or other suitable material.

Figure 2:
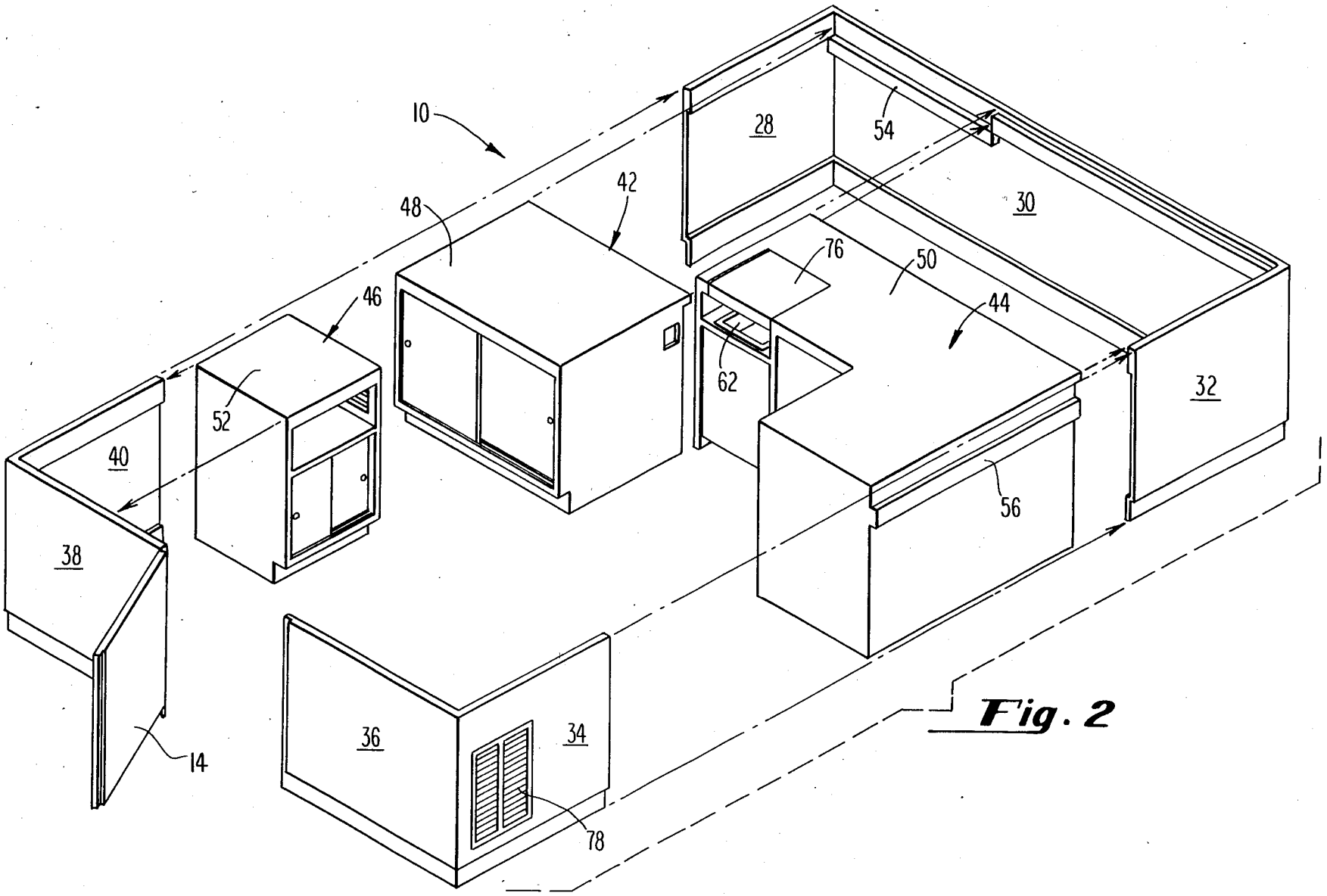
FIG. 2 is an exploded perspective view of the base portion of the booth, illustrating the positioning of the vertical panels and the cabinet units.
Figure 3:
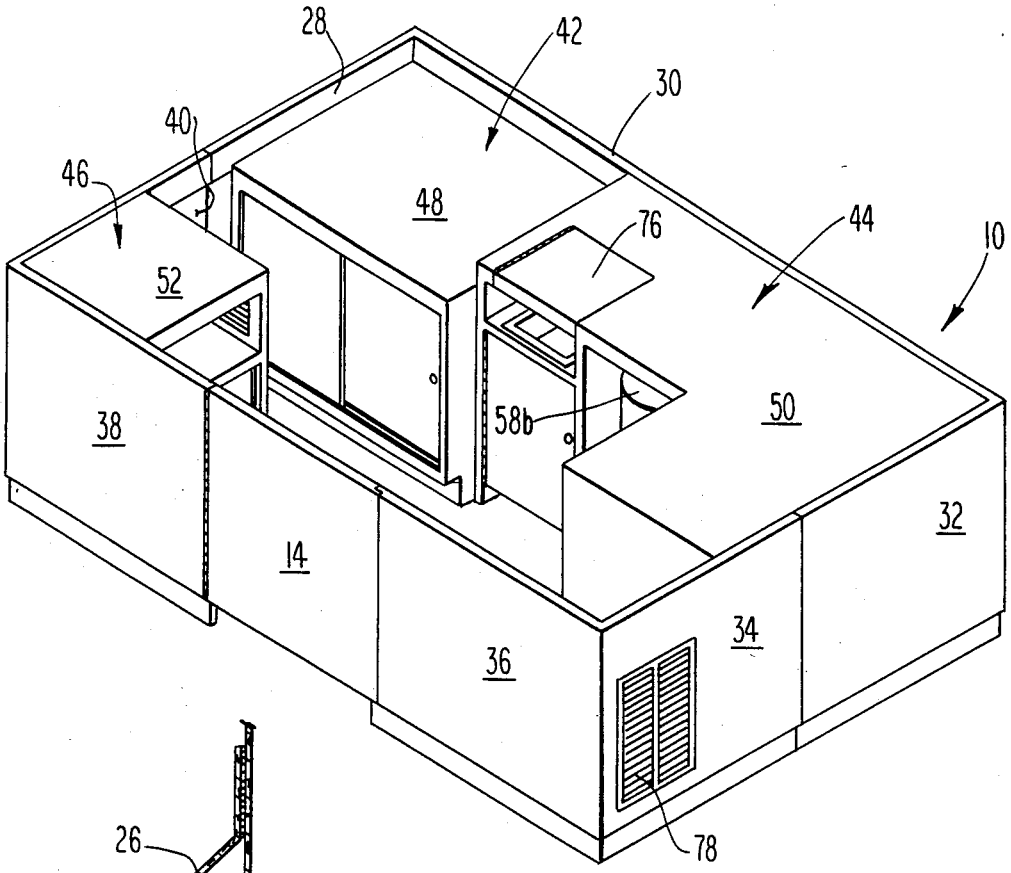
FIG. 3 is a perspective view of the base portion of the booth in full assembled form.

With reference to FIGS. 2 and 3, the base portion 10 comprises a plurality of vertical panels 28–40 arranged to form a substantially rectangular enclosure. As seen in FIG. 2, it is most preferable to combine panels 28,30, and 32 into a single three-sided piece which forms a clean continuous surface on the front half of the base portion 10. Likewise, it is perferable to combine panels 34,36 and 38,40 to form two corner units, respectively, which form the back half of the base portion. In this construction of the booth, the seams between the adjacent units are disposed of the side of the booth, thus presenting a cleaner overall appearance to the public. The door 14 is preferably provided in the back of the portion 10, and may be of any suitable type to provide ease of access to the booth for employees.

A plurality of cabinet units 42–46, each having a substantially planar top surface 48–52, are positioned within the enclosure so as to abut the panels, the planar sufaces 48–52 thus forming a counter surface within the enclosure, which may be used to support various food service equipment and to provide a work surface for employees. (See FIG. 3). It is perferable for as many cabinet units as possible to be of such size and dimension so that the planar top surface lies flush with the upper edge of the vertical panels, although the height of the top surface may be varied depending on the type of equipment to be supported thereon. To faciliate the assembly and placement of the cabinet units into the base enclosure, guide members such as members 54 on panel 30 and member 56 on cabinet 44 may be provided, if desired.

Disposed within the cabinet units 42 and 44 underneath the planar top surfaces 48 and 50, respectively, are the first and second plumbing systems which allow the booth structure to be self-contained and eliminate the need for an external plumbing system. The first and second plumbing systems are schematically illustrated in FIG. 6.

Figure 6:
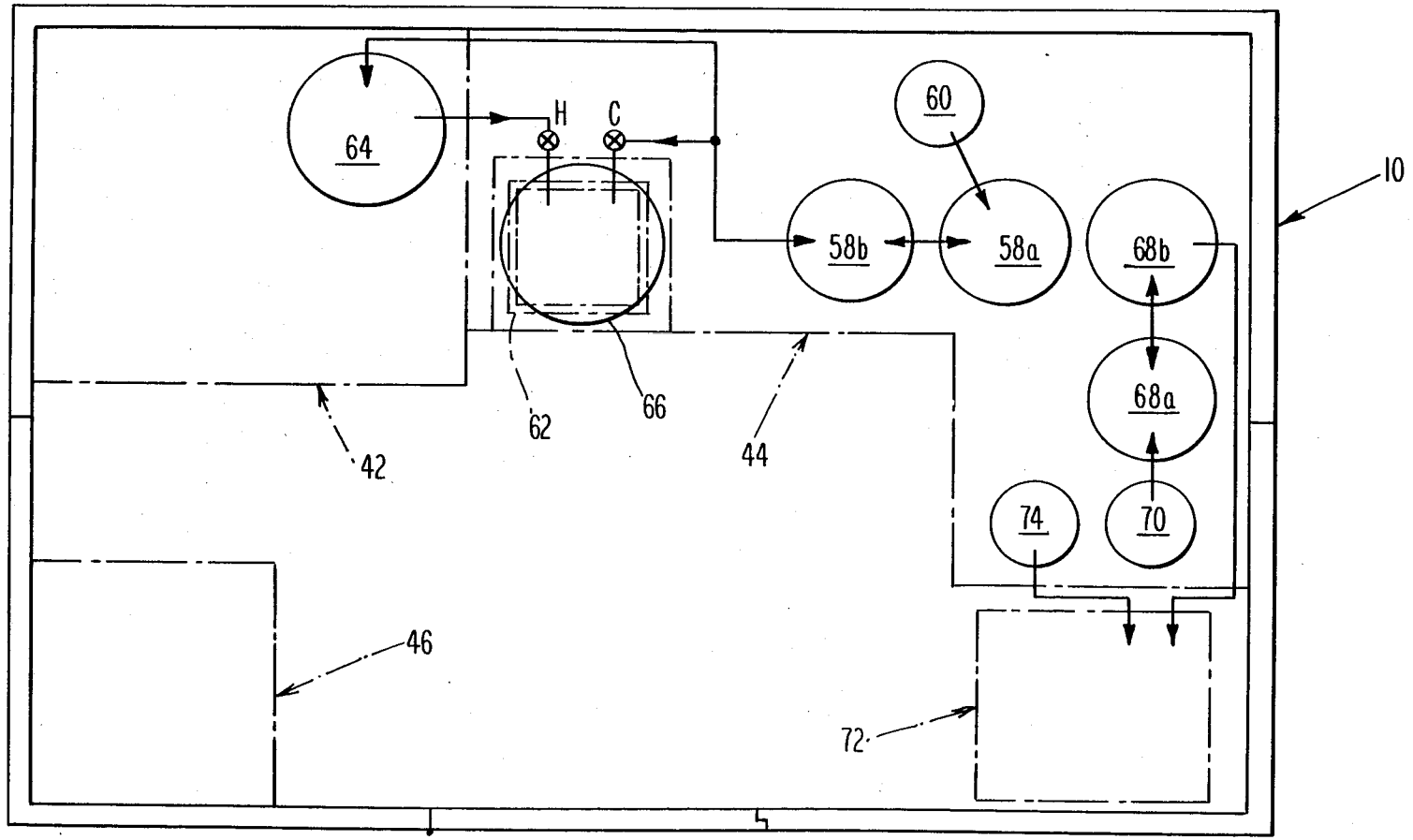
FIG. 6 is a schematic represenation of the first and second plumbing systems of the invention, and taken along line 6—6 of FIG. 3.

With reference to FIG. 6, the first plumbing system comprises a pair of water tanks 58*a*, 58*b*, a carbon dioxide tank 60, sink means 62 (see FIGS. 2,3), a heater unit 64, and a holding tank 66. The first plumbing system comprises means for storing, delivering and collecting hot and cold water to a receptacle, such as sink means 62. Water tanks 58*a,b* are in fluid communication with one another and tank 58*b* is in fluid communication with sink means 62 and heater unit 64. Carbon dioxide tank 60 is in fluid commmunication with water tank 58*a* and comprises means for delivering water from tanks 58*a,b* to the sink means 62. Heater unit 64 is provided with suitable fluid conduits connecting it to sink means 62 whereby water from tanks 58*a,b* may be heated prior to delivery to the sink means 62. Sink means 62 is in fluid communication with holding tank 66 whereby waste water discharged from sink means 62 is retained for later removal.

As also seen in FIG. 6, the second plumbing system comprises a pair of water tanks 68*a,b* in fluid communication with one another. A carbon dioxide tank 70 is in fluid communication with tank 68*a* and comprises means for delivering water from tanks 68*a,b* to a beverage dispenser, diagrammatically represented at 72, via any suitable fluid conduit. A second carbon dixoide tank 74 is also provided in direct fluid communication with beverage dispenser 72 and supplies carbon dioxide to the beverage dispsenser for making carbonated beverages.

With reference to FIGS. 2 and 3, the portion of top surface 50 directly above the sink means 62 is preferably a removable or openable structure, such as door 76, to provide easy access to sink means 62, when desired, and yet conceal the sink means from the customer's view when it is not in use.

As can be seen in FIG. 3, when assembled, base portion 10 forms an integrated and self-contained unit for the efficient service and sale of food and drink items. Furthermore, because it is self-contained, the need for an external plumbing system is obviated, thus increasing the overall utility of the modular booth structure and facilitating the use of the booth in existing building structures. If desired, an air vent 78 may be provided in one of the vertical panels, such as panel 34, to assure adequate air flow about a piece of food or beverage equipment.

Figure 4:
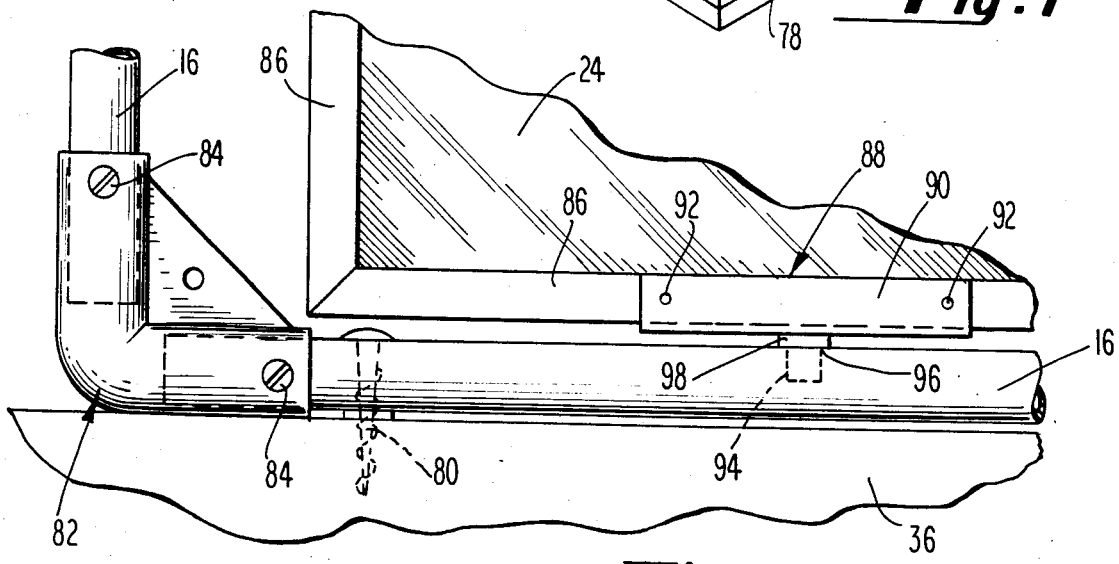
FIG. 4 is an enlarged elevational view of area 4 in FIG. 1, illustrating the preferred method of constructing the cover portion and the transparent panels.

With reference now being made to FIG. 4, the pipes 16 are connected to the vertical panels of base portion 10 by a plurality of wood screws 80 or other suitable fasteners disposed through pipes 16 and into the panels. The pipes 16 of cover portion 12 are joined together at their terminal ends by angled bracket 82. In the view shown in FIG. 4, bracket 82 is an elbow shaped member connected to the terminal ends of adjacent pipes 16,16 by screws 84, whereby pipes 16,16 are disposed at a substantially right angle to one another. It is to be understood, however, that angled brackets 82 are of such size and shape so as to retain the plurality of pipes 16 in a predetermined orientation to form a lattice having the structure described above and illustrated in FIG. 1.

As mentioned above, it is preferable to have a plurality of transparent panels 24 affixed to the pipes 16 comprising the vertical component 18 of cover portion 12. Transparent panels 24 thus provide an effective barrier between the customer and the equipment contained within the booth and may be provided with suitable indicia advertising the products available for purchase from the booth, if desired. To facilitate access to the booth, that portion of the vertical component 18 directly above door 14 is not provided with a transparent panel. Likewise, the front of the vertical component 18 directly across from the door 14 is left open, i.e., no transparent panel is disposed therein, to facilitate service to the customers.

Figure 5:
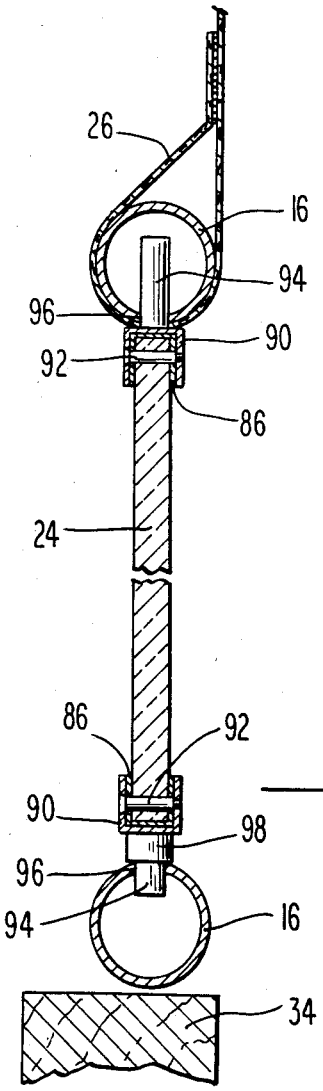
FIG. 5 is a sectional view of the cover portion and transparent panel as taken along line 5—5 of FIG. 1.

As seen in FIGS. 4 and 5, the transparent panels 24 are preferably contained within a frame 86 to provide a cleaner appearance. The frame 86 may be of any known construction, such as for example extruded aluminum. Transparent panels 24 are rigidly affixed to pipes 16 of vertical component 18 of cover portion 12 by a plurality of brackets 88 disposed in spaced-apart relation along the horizontal edges of transparent panels 24, with two brackets on each horizontal edge being most preferable.

Brackets 88 comprise a U-shaped channel member 90 into which transparent panel 24 and frame 86, if used, are received. The channel member 90 may be affixed to transparent panels 24 by any known method, such as for example by rivet pins 92. A dowel pin 94 is provided and extends vertically outwardly from the bottom of the channel member 90 and is closely received within a suitable aperture 96 in pipes 16. As seen in FIG. 5, dowel pins 94 are thus disposed within the interior of pipes 16 whereby transparent panels 24 are rigidly retained in the vertical disposition. It is also preferable for the transparent panels 24 to be spaced from the pipe 16 at the bottom thereof and to this end, dowel pins 94 of brackets 88 to be used on the lower horizontal edge of the transparent panels may be provided with an annular flange 98 which is disposed against the bottom of channel member 90.

In accordance with the above-described construction, it can be seen that an efficient, attractive, self-contained merchandising booth is obtained which is inexpensive to manufacture, easy to assembly, and which is capable of being installed in any existing building structure without any expensive or extensive alterations.

Preferred forms of the invention have been described for purposes of illustration and are not to be construed as a limitation thereof and it is to be understood that various alternatives and modifications may suggest themselves to those skilled in the art, all of which are within the scope and spirit of the invention as defined by the appended claims.

What is claimed is:

1. A modular booth structure for use in merchandising food and drink items comprising a cover portion and a base portion supporting said cover portion, (a) said base portion comprising a plurality of vertical panels interconnected edge to edge to form a substantially rectangular enclosure, one of said vertical panels being hinged to an adjacent panel to form a door in said enclosure;

(1) a plurality of cabinet units within said enclosure and comprising substantially planar top surfaces, said cabinet units positioned within said enclosure so as to abut an inside surface of said vertical panels, wherein said planar top surfaces of said cabinets form a substantial counter within an inside perimeter of said enclosure;

(i) wherein said plurality of cabinet units include a plumbing system comprising: a sink affixed to one of said cabinet units; at least one water tank for storing water, said water tank being in fluid communication with said sink; means for pressurizing said at least one water tank to force water from said water tank to said sink; and means for collecting and holding waste water discharged from said sink;

(ii) said plurality of cabinet units further comprising at least one water tank adapted for use with a beverage dispenser; means for pressurizing said at least one water tank to force water from said tank to a beverage dispenser; and a carbon dioxide tank adapted for use with a beverage dispenser, said carbon dioxide tank comprising means for storing and delivering carbon dioxide to a beverage dispenser;

(b) said cover portion comprising a plurality of pipes connected together to form a lattice structure, said lattice structure comprising:

(1) a vertical component affixed to said vertical panels of said base portion so as to form a substantially vertical extension of said vertical panels; and (2) a horizontal component disposed across an upper end of said vertical component.

2. The booth of claim 1, with said lattice structure further including an angled component affixed to said vertical component and to said horizontal component and interconnecting said vertical component to said horizontal component.

3. The booth of claim 2, wherein said cover portion further comprises angular braket members affixed to said pipes at terminal ends thereof, said bracket members comprising means for connecting and retaining adjacent pipes together in predetermined orientation to form the vertical, horizontal and angled components of said lattice structure.

4. The booth of claim 3, wherein said vertical component of said lattice structure comprises a plurality of substantially rectangular openings defined by said pipes and including a plurality of transparent panels disposed within said rectangular openings and means for affixing said transparent panels to said pipes defining said rectangular openings.

5. The booth of claim 4, wherein said plurality of transparent panels comprise rectangular panels of a clear plastic material.

6. The booth of claim 5, wherein said means for affixing said clear plastic panels to said pipes comprise:

(a) a pair of elongate U-shaped brackets affixed to each horizontal edge of said plastic panel;

(b) a dowel pin extending perpendicularly from said U-shaped brackets, at least some of said dowel pins having an annular flange disposed thereon adjacent to said U-shaped bracket; and (c) a plurality of holes in said pipes of such size and location so as to receive said dowel pins therein, wherein said annular flange of said dowel pins comprises means for spacing a lower horizontal edge of said plastic panels from said pipes.

7. The booth of claim 6, wherein said means for pressurizing said at least one water tank to force water from said water tank to said sink comprises a tank of carbon dioxide gas in fluid communication with said at least one water tank, and wherein said means for pressurizing said at least one water tank to force water from said water tank to a beverage dispenser comprises a tank of carbon dioxide gas in fluid communication with said at least one water tank.

8. The booth of claim 7, wherein said sink is affixed to said cabinet unit below said planar top surface of said cabinet whereby said sink is concealed from view, wherein said planar top surface above said sink is openable, wherein said plumbing system further comprises a heater unit in fluid communication with said at least one water tank and said sink for heating water delivered to said sink, and wherein said means for collecting and holding waste water discharged from said sink comprises a portable tank disposed below said sink and connected thereto by a conduit.

* * * * *